United States Patent [19]

Geske

[11] Patent Number: 4,869,032

[45] Date of Patent: Sep. 26, 1989

[54] APPARATUS AND METHOD FOR WATERPROOFING BASEMENTS

[76] Inventor: Darel R. Geske, 7267 Lilac, Excelsior, Minn. 55331

[21] Appl. No.: 100,936

[22] Filed: Sep. 25, 1987

[51] Int. Cl.[4] ..... E04B 1/70; E04F 17/00

[52] U.S. Cl. ..... 52/169.5; 52/274; 52/287; 52/303; 405/43

[58] Field of Search ..... 52/169.5, 288, 58, 61, 52/532, 533, 534, 303, 274, 287; 404/2, 4; 405/36, 43, 44, 48

[56] References Cited

U.S. PATENT DOCUMENTS

| | | | |
|---|---|---|---|
| 3,283,460 | 11/1966 | Patrick | 52/169.5 |
| 3,850,193 | 11/1974 | Guzzo | 52/169.5 |
| 3,852,925 | 12/1974 | Gazzo | 52/169.5 |
| 4,045,964 | 9/1977 | Barclay | 61/11 |
| 4,185,429 | 1/1980 | Mendola | 52/169.5 |
| 4,245,443 | 1/1981 | Beechen | 52/169.5 |
| 4,253,285 | 3/1981 | Enright | 52/169.5 |
| 4,265,064 | 5/1981 | Parezo | 52/169.5 |
| 4,538,386 | 9/1985 | DiCello | 52/169.5 |
| 4,612,742 | 9/1986 | Bevilacgua | 52/169.5 |
| 4,745,716 | 5/1988 | Kuypers | 52/169.5 |

*Primary Examiner*—Michael Safavi

*Attorney, Agent, or Firm*—Merchant, Gould, Smith, Edell, Welter & Schmidt

[57] ABSTRACT

A drainage control apparatus (10) for basements having a poured concrete floor (27). A plurality of drainage structure (10) each have a vertical leg (15) and a horizontal leg (14), with the vertical leg (15) being positioned proximate to the vertical side wall (11) of the basement and the horizontal leg (14) resting upon the top of the foundation footing (12). The vertical leg (15) includes a plurality of outwardly protruding embossments (20) proximate the bottom end of the vertical leg (15). The vertical leg (15) also includes an outwardly projecting, longitudinal spacer lip (21) proximate the upper end (22) of the vertical leg (15). Both the embossments (20) and spacer lip (21) touch the vertical basement side wall (11) to maintain a gap (26) between the vertical leg (15) and the vertical side wall (11). The horizontal leg (14) of the drainage structure (10) includes a plurality of channels (25) to direct water into a drain pipe (18). A corner drainage control apparatus (32) for the corners of basements is also disclosed. The present invention also comprises a method for installing a drainage control apparatus (10) into basements, comprising the steps of constructing the foundation; installing a drainage structure (10) proximate the vertical side wall (11) so that a gap (26) exists proximate the vertical side wall (11); pouring concrete for the basement floor (27) so that the concrete flows against the drainage structure (10) and into embossments (20) in the drainage structure (10); hardening the contact slab floor (27); and cutting a top portion offf the drainage structure (10) so that it is flush with the top of the concrete floor (27) and so that a gap (26) exists between the concrete floor's edge and the basement side wall (11).

3 Claims, 3 Drawing Sheets

APPARATUS AND METHOD FOR WATERPROOFING BASEMENTS

FIELD OF THE INVENTION

The present invention relates generally to a waterproofing system, and more particularly to a drainage system adapted for installation under a concrete basement floor to provide a dry basement in a dwelling or other building.

BACKGROUND OF THE INVENTION

A well-known problem in buildings having basements is seepage of water into the basement, especially following periods of heavy precipitation. This seepage frequently accumulates at the floor line of the basement and, if not controlled, can cause substantial damage to the interior basement walls and to the contents of the basement.

This water seepage gets into the basement through cracks in the foundation walls which develop over time. Moreover, porous building materials, such as concrete block, are susceptible to percolation and seepage of water through the building material itself and into the interior portion of the structure. Another source of moisture arises from capillary action and water vapor.

Many ways of solving the seepage problem have been devised but have met with only limited success, often because of costliness and difficulty of installation. Attempting to seal the cracks in the foundation wall, either from the inside or from the outside, is not only very costly but generally is also ineffective. Further, moisture-resistant flashings or coatings tend to fracture and tear due to building expansion, settling, and careless installation.

It is common to drain off water in the vicinity of a building or structural foundation through a subterranean drain pipe disposed in a bed of aggregate gravel at the base of the foundation footing. However, such systems are frequently ineffective due to such factors as improper design or installation, or clogging of the drain pipe or the surrounding aggregate bed. Accordingly, attempts have been made to efficiently transport the water to the drain pipe. For example, hoses have been installed which interconnect the hollow center of the concrete block wall to the drain pipe or surrounding aggregate. This construction is not only costly and time-consuming to fabricate, but the hose openings tend to become plugged, thus reducing their effectiveness. Also, this solution is not effective for water which seeps into the interior of the basement.

Another proposal in an attempt to drain water from the interior of the basement is to place a plywood board against the foundation wall before the concrete slab floor is poured. The board is then removed while the concrete is still "green" and not completely set. However, there are several disadvantages to this procedure: it causes damage to the edge of the concrete floor; it results in additional labor costs; and it may cause the concrete floor to shift.

The present invention addresses these and many other problems associated with currently available drainage systems.

SUMMARY OF THE INVENTION

The present invention comprises a drainage control apparatus for basements having a poured concrete floor. The drainage system includes a plurality of drainage structures in an end-to-end abutting relationship. Each drainage structure has a vertical leg and a horizontal leg, with the vertical leg being positioned proximate to the vertical side wall of the basement and the horizontal leg resting upon the top of the foundation footing. The vertical leg includes a plurality of outwardly protruding embossments proximate the bottom end of the vertical leg. The vertical leg also includes an outwardly projecting, longitudinal spacer lip proximate the upper end of the vertical leg. Both the embossments and spacer lip touch the vertical basement side wall to maintain a gap between the vertical leg and the vertical side wall. The horizontal leg of the drainage structure includes a plurality of channels to direct water into a drain pipe.

According to another aspect of the invention, a corner drainage control apparatus for the corners of basements is disclosed. The corner drainage apparatus includes a horizontal leg and two vertical legs. The vertical legs have a longitudinal spacer lip and a plurality of embossments. The horizontal leg of the corner drainage apparatus contains a plurality of drainage channels.

Another aspect of the present invention comprises a method for installing a drainage control apparatus into basements. This method comprises the steps of constructing the foundation's footings and basement side walls; installing a plurality of drainage structures proximate the vertical side wall and footing so that a gap exists between the vertical leg and vertical side wall; pouring concrete for the concrete slab floor so that the concrete flows against the drainage structure and into embossments in the drainage structure; hardening the contact slab floor; and cutting a top portion off the drainage structure so that it is flush with the top of the concrete floor and so that a gap exists between the concrete floor's edge and the basement side wall.

The present invention is particularly advantageous in that it effectively drains water from the interior of the basement. Moreover, the drainage system of the present invention effectively drains water from whatever area it enters the basement, whether the water is inside the concrete block, or whether the water seeps into the interior of the basement wall at a high or low point above the basement floor.

Another feature of the present invention is that it is easy to install. The invention has a relatively simple, one-piece construction which adapts easily to the ordinary components of a foundation wall. Consequently, labor time and costs are reduced.

In addition, the drainage system of the present invention is not visible after it is installed. The drainage system also does not interfere with any finishing work on the basement's floor or walls.

For a better understanding of the invention, and of the advantages obtained by its use, reference should be had to the drawings and accompanying descriptive matter in which there is illustrated and described a preferred embodiment of the present invention.

BRIEF DESCRIPTION OF THE DRAWINGS

Referring particularly to the drawings, wherein like reference numerals indicate like parts throughout the several views.

DESCRIPTION OF THE PREFERRED EMBODIMENT

Figure 1:
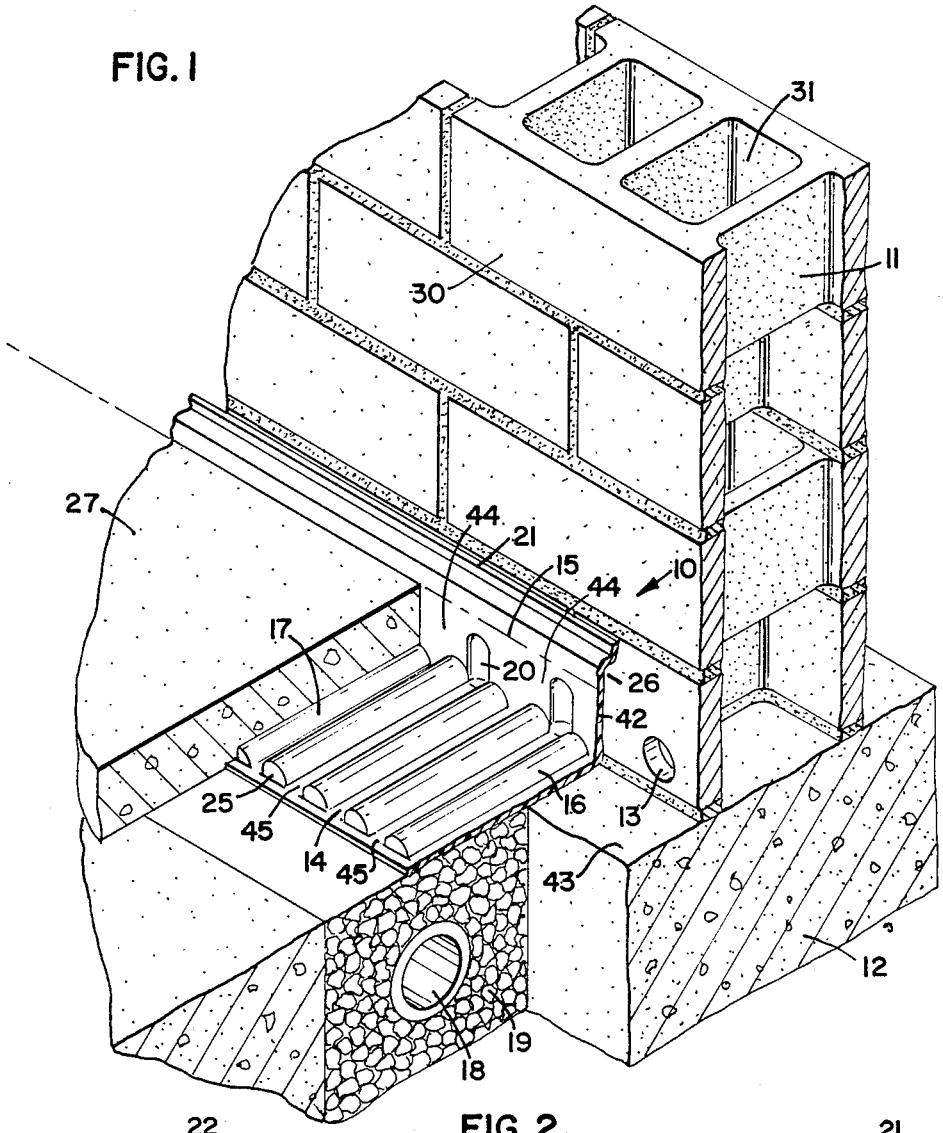
FIG. 1 is a perspective sectional view of the drainage control device of the present invention installed within the foundation of a building.

The drainage control apparatus of the present invention, installed in the basement foundation of a structure, is shown generally at 10. The basement or foundation wall 11 is illustrated in FIG. 1 as being constructed of concrete block, but it is to be understood that the drainage control device 10 of the present invention could be used with a wide variety of construction materials. The vertical concrete side wall 11 rests upon a transverse footing 12.

Figure 5:
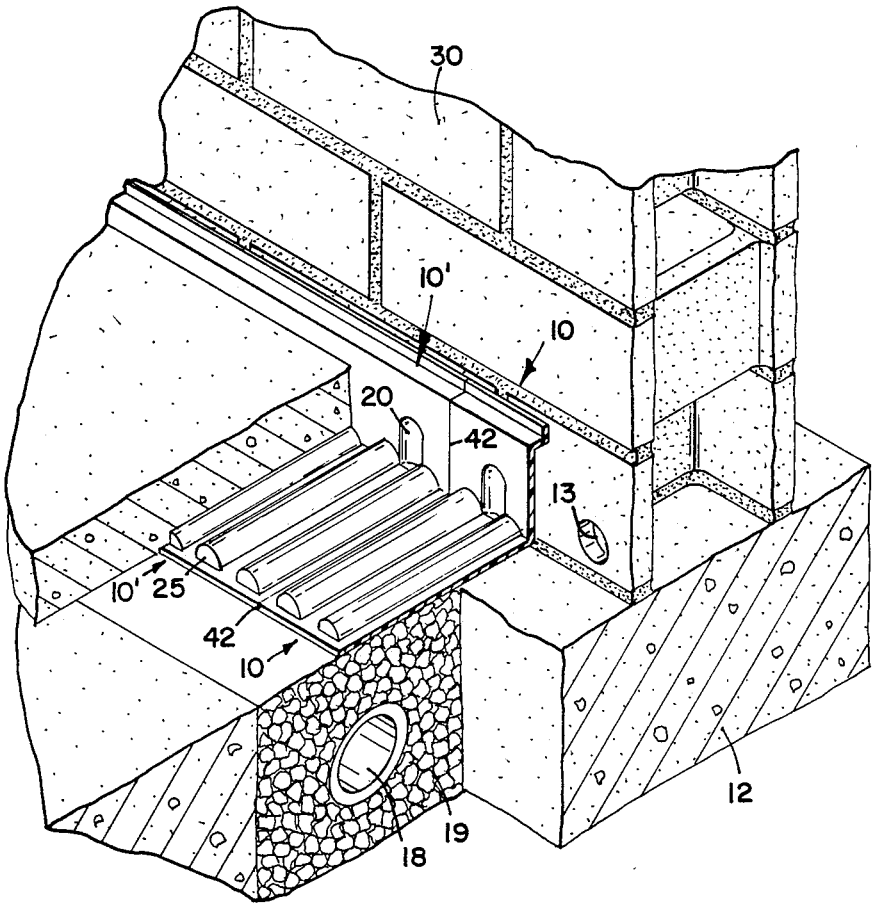
FIG. 5 is a perspective sectional view of the drainage control device of the present invention illustrating drainage structures in an end to end abutting relationship.

The drainage apparatus 10 of the present invention has a horizontal leg 14 and a vertical leg 15. The legs 14 and 15 are preferably at right angles to each other. As shown in FIG. 5, plurality of drainage structures 10' are placed along the entire periphery of the basement wall 11, and the horizontal leg 14 preferably sits upon the transverse footing 12. The structures 10 are placed end to end so that the outside edges 42 of the respective vertical and horizontal legs 15, 14 are in abutment. Each individual structure 10 is approximately four (4) feet in length in the preferred embodiment. In addition, the length of a drainage structure 10 can be easily adjusted by cutting it with a utility knife, so that the length of the end-to-end drainage structures 10 exactly matches the length of each basement wall 11.

As shown in FIG. 1, an outward end 16 of the horizontal leg 14 of the drainage structure 10 rests upon the top 43 of the footing 12. An inner end 17 of the horizontal leg 14 extends beyond the footing 12 and inward toward the interior of the basement. In the preferred embodiment, the inner end 17 of the horizontal leg 14 extends so as to terminate substantially above a conventional underground drain pipe 18. The drain pipe 18 has apertures (not shown) in its wall to collect water, and it is surrounded by drainage aggregate 19. Preferably, the drain pipe 18 extends parallel to the length of the drainage structure 10 and the basement wall 11, and is on the interior side of the foundation wall 11.

Figure 2:
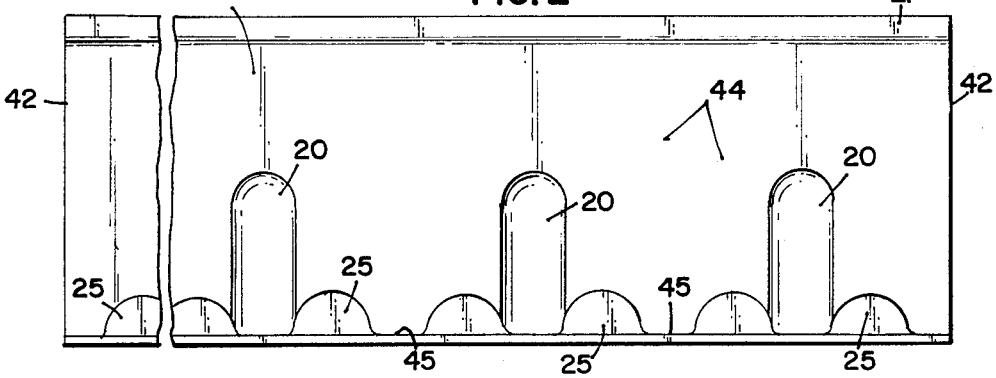
FIG. 2 is a front elevational view of the drainage control device shown in FIG. 1.
Figure 3:
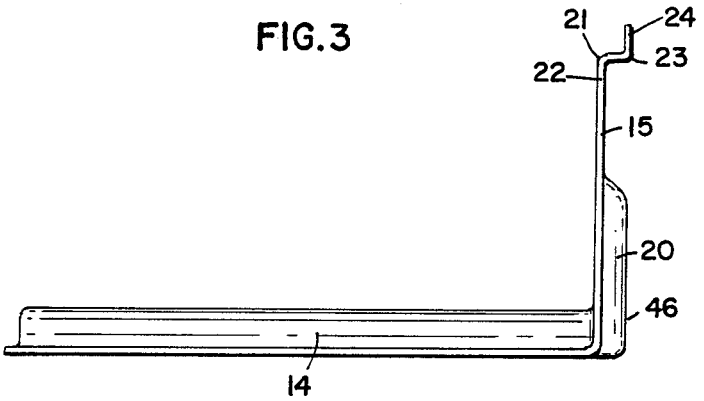
FIG. 3 is a side elevational view of the drainage control device illustrated in FIGS. 1 and 2.

The vertical leg 15 of the drainage structure 10 includes a plurality of embossments 20. These embossments 20 protrude outwardly from the vertical leg 15, so that the embossments 20 abut the interior surface 30 of the concrete wall 11. The vertical leg 15 includes smooth flat interconnecting portions 44 between and above the embossments 20. The embossments 20 cause the remainder of the vertical leg 15, i.e., the interconnecting portions 44, to be spaced away from the wall 11. As shown in FIGS. 2 and 3, the embossments 20 preferably have rounded corners. Also, the back wall 46 of each embossment 20 is flat and smooth so as to be flush against the basement wall 11.

In the preferred embodiment, the embossments occupy approximately the lower half of the vertical leg 15, and are preferably less than three and one-half ($3\frac{1}{2}$) inches tall. They are approximately one (1) inch in width, and are spaced approximately four (4) inches apart. The vertical leg 15 is preferably five and one-half ($5\frac{1}{2}$) inches tall.

The drainage structure 10 also includes a longitudinal spacer lip 21. In the preferred embodiment, the spacer lip 21 is continuous and is located along the upper edge of the vertical leg 15. The spacer lip 21 contains a horizontal, outwardly extending portion 23 and a vertical portion 24, with the vertical portion 24 abutting the concrete wall 11. The embossments 20 and spacer lip 21 are sized and configured so that both the spacer lip 21 and embossments 20 abut the concrete wall 11 when the vertical leg 15 is positioned against the inside 30 of the foundation wall 11.

Thus, there is a gap 26 maintained between the vertical leg 15 and the inside 30 of the concrete wall 11 except where the embossments 20 and spacer lip 21 are located. The width of the gap 26 is approximately three-eighths ($\frac{3}{8}$) inch in the preferred embodiment.

Preferably, the drainage structure 10 is an integral, unitary structure which is made of polystyrene and in a vacuum-formed process. Alternatively, the structure could be formed by a plastic injection molding process. As a consequence, the drainage device 10 is lightweight yet sturdy.

The horizontal leg 14 of the drainage structure 10 contains a plurality of longitudinal parallel channels 25. The channels 25 extend from the concrete wall 11 at a right angle. The horizontal leg 14 and the channels 25 are approximately one (1) foot in length in the preferred embodiment. Between adjacent channels 25 are flat interconnecting portions 45. In the preferred embodiment, the channels 25 are spaced to be approximately two (2) inches apart center-to-center, and each channel 25 is approximately one and one-half ($1\frac{1}{2}$) inches wide. The channels 25 have, in the preferred embodiment, a substantially semicircular cross-section and are concave at the bottom of the horizontal leg 14. Thus, water can drain into the gap 26 and then flow in the channels 25 under the horizontal leg 14 and downward through the aggregate 19 and into the drain pipe 18. If dirt or other matter blocks the channels 25, it can be removed by means of a pressure hose.

The drainage structure 10 is installed after construction and installation of the footing 12, the drain pipe 18 and aggregate 19, and the concrete block wall 11. The drainage structure 10 is positioned so that the embossments 20 and spacer lip 21 are flush against the inside surface 30 of the concrete wall 11 and so that the horizontal leg 14 of the drainage structure 10 rests upon the footing 12. The drainage structure 10 can be nailed in place if necessary. The concrete floor 27 is then poured. The concrete flows against the vertical leg 15 and into the embossments 20. Because of the configuration and design of the structure 10, the pressure of the concrete on the vertical leg 15 does not cause it to deflect against the wall 11. The height of the concrete floor 27 is less than the height of the vertical leg 15 of the drainage structure 10.

After the concrete has been allowed to harden and obtain sufficient strength, the top portion 22 of the drainage structure 10, which includes the spacer lip 21, is cut off. The drainage structure 10 is cut so that the top edge of the drainage structure 10 will be the same height as the top of the concrete floor 27. Because the drainage structure 10 is preferably made of a plastic material such as polystyrene, it can be cut with a conventional utility knife. The top should be cut off preferably as the last step in the process to prevent dust due to construction from entering the gap 26. In this manner, a clear gap 26 is formed between the edge 29 of the concrete slab floor 27 and the inside surface 30 of the concrete wall 11. Also, the concrete floor 27 need not be constructed to be a precise height in order to match the height of the drainage structure, because the top portion 22 of the drainage structure 10 is cut off as necessary.

Thus, when water seeps into the interior of the basement, it will run down the inside 30 of the wall 11, and it will be caught within the gap 26 and carried through the channels 25 and into the drain pipe 18.

If water flows into the hollow openings 31 of the concrete block wall 11, it will fall to the bottom and flow through optional "weep holes" 13 and out through the drainage structure 10. The weep holes 13 are apertures in the side of the concrete block at spaced intervals. The weep holes 13 can be either drilled in the concrete block wall 11 or the concrete block can be purchased with prefabricated weep holes. Even if no weep holes 13 are present, the drainage apparatus 10 of the present invention will drain away water once it seeps into the interior of the basement.

It should be noted that the present invention could be installed in existing buildings as well as new construction. The drainage structure 10 could be installed after removing the outside periphery (18–20") of the existing basement floor 27.

The corner drainage structure of the present invention is shown generally at 32. The corner drainage structure 32 includes a horizontal leg 33 and two vertical legs 34, 35 which extend upward from two sides of the horizontal leg 33. Along the upper edge of the vertical legs 34, 35 are continuous spacer lips 36, 37 respectively. The configuration of the spacer lips 36, 37 is similar to the spacer lip 21 utilized with the drainage structure 10.

The corner drainage structure 32 is preferably a single, unitary plastic piece made of polystyrene in a vacuum-formed process. In the alternative the piece could be formed from a plastic injection molding processes. The edges 41 of the corner drainage piece 32 should abut the edges 42 of the standard drainage structure 10 so that a continuous gap 26 is maintained around the periphery of the basement.

Figure 4:
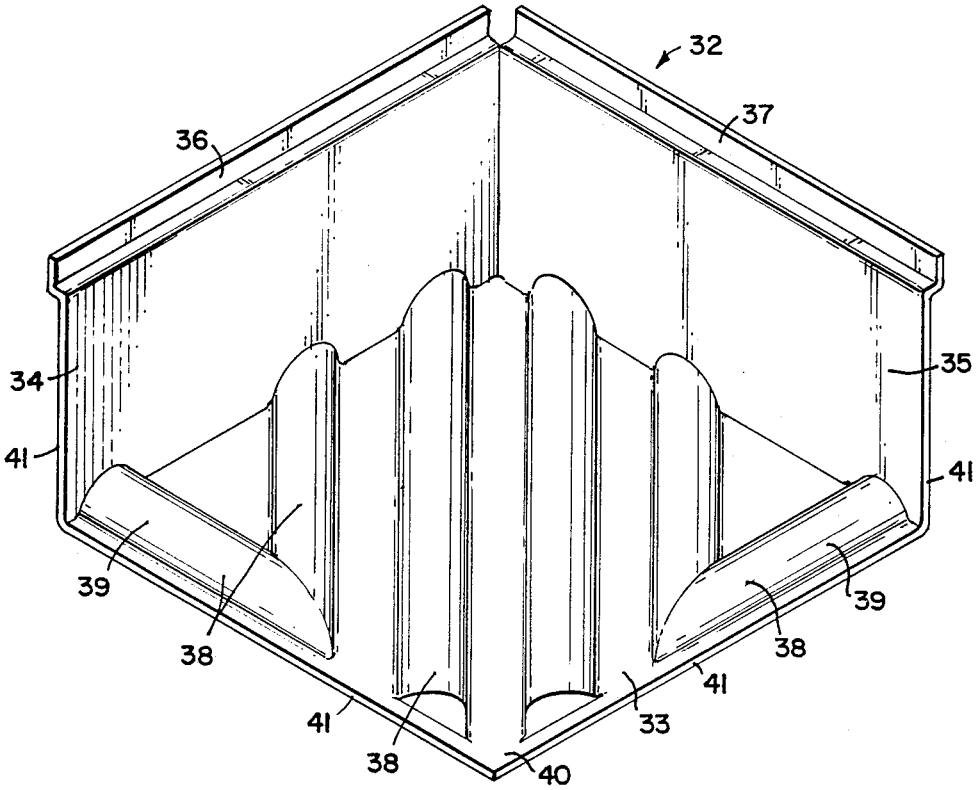
FIG. 4 is a perspective view of the corner piece of the drainage control device of the present invention.

The horizontal leg 33 of the corner drainage structure 32 can be of any shape, but is preferably substantially square. The horizontal leg 33 includes a plurality of channels 38. A plurality of the channels 38 are parallel and extend from the vertical legs 34, 35 at an oblique angle, preferably 45 degrees. Also, a plurality of end channels 39 may extend at a right angle from the vertical legs 34, 35 as shown in FIG. 4, and converge with channels 38. Thus, the water is directed into a gap 26 behind the vertical legs 34, 35 and into the channels 38, 39 toward the most inward corner 40 of the horizontal leg 33. The corner drainage piece 32 can also include a plurality of embossments, although none are shown in FIG. 4.

It is to be understood that numerous and various modifications can be readily devised in accordance with the principles of the present invention by those skilled in the art without departing from the spirit and scope of the invention. Therefore, it is not desired to restrict the invention to the particular constructions illustrated and described but to cover all modifications that may fall within the scope of the appended claims.

What is claimed is:

1. A drainage control apparatus for basements of the type having a poured concerete floor and vertical side walls resting on footings, a portion of which extend inwardly from each respective side wall, comprising: a plurality of drainage structures in an end-to-end abutting relationship, each drainage structure having a vertical leg and a horizontal leg at right angles to each other, each drainage structure being formed as an single, unitary member, said vertical leg including a plurality of outwardly protruding embossments abutting said vertical side wall so that a gap exists between said vertical leg and said vertical side wall, said embossments extending from a bottom end of said vertical leg to a middle section of said vertical leg, an upper section of said vertical leg being substantially planar, said horizontal leg including a plurality of channels to transport water beneath said basement floor, a drain pipe being beneath said drainage control apparatus which is surrounded by drainage aggregate, said drain pipe being located on an interior side of said footing, wherein an outer portion of said horiziontal leg is positioned upon said footing and an inner portion of said horizontal leg is positioned above said drain pipe, the concrete floor being positioned directly above said horizontal leg of said drainage control apparatus, said apparatus including an outwardly projecting, longitudinal spacer lip proximate an upper end of said vertical leg, said spacer lip abutting said vertical side wall, wherein both said embossments and said spacer lip touch said vertical side wall.

2. The drainage control apparatus of claim 1, wherein said drainage control apparatus is made of polystyrene.

3. A corner drainage control apparatus for the corners of basements, said basements being of the type having a poured concrete floor and vertical side walls resting on footings, a portion of which extend inwardly from each respective side wall, comprising: a corner drainage structure having a horizontal leg and two vertical legs rising up from two sides of said horizontal leg, said vertical legs each including an outward-projecting, longitudinal spacer lip proximate an upper end of said vertical legs, said spacer lips abutting said vertical side walls, said horizontal member including a plurality of channels to transport water beneath said floor, wherein said horizontal leg and said two vertical legs are at right angles to each other, said vertical legs having a plurality of outwardly protruding embossments said embossments abutting said vertical side walls, wherein said corner struture is made of polystyrene and wherein a plurality of said channels are parallel and are configured to be at an oblique angle with respect to said vertical legs.

* * * * *